United States Patent [19]

Gladwin

[11] 4,356,860

[45] Nov. 2, 1982

[54] CONTINUOUS CASTING MOLD SIDE WALL ADJUSTMENT SYSTEM

[76] Inventor: Kirk M. Gladwin, 21000 E. River, Grosse Ile, Mich. 48138

[21] Appl. No.: 183,341

[22] Filed: Sep. 2, 1980

[51] Int. Cl.[3] ..... B22D 11/00

[52] U.S. Cl. ..... 164/451; 164/491; 164/436; 164/150

[58] Field of Search ..... 164/491, 436, 451, 150, 164/154

[56] References Cited

U.S. PATENT DOCUMENTS

| | | | |
|---|---|---|---|
| 3,338,295 | 8/1967 | Scribner | 164/413 X |
| 3,964,727 | 6/1976 | Gladwin | 164/436 X |
| 4,171,719 | 10/1979 | Wunnenberg et al. | 164/436 X |

*Primary Examiner*—Gus T. Hampilos
*Assistant Examiner*—K. Y. Lin
*Attorney, Agent, or Firm*—Cullen, Sloman, Cantor, Grauer, Scott & Rutherford

[57] ABSTRACT

An apparatus and method for accurately and quickly adjusting the distance and tilt angle or taper between movable side wall mold plates in adjustable width continuous casting mold sections. A pair of spaced primary mold members with movable side wall mold plates therebetween, form an open ended mold cavity. Each side wall mold plate is connected to upper and lower fixed mold supports by separate upper and lower adjustable length connectors which have their inner ends hinged to the side wall mold plates. Each connector has an axial bore receiving a transducer core for reciprocating movement along a linear path. A cylindrical transducer coil housing in the bore, fixed relative to the mold cavity center, surrounds the movable core. The transducer core has one end anchored to a side wall mold plate. Adjustment of the side wall mold plate causes corresponding axial movement of the core relative to the coil enabling calibration of an electrical signal for computing the distance of the side wall mold plate from the mold cavity center. By using a separate linear transducer on each of the upper and lower connectors, any tilt or taper of the side wall may also be determined. Alternatively, one linear transducer may be replaced by an angular transducer, e.g., an inclinometer, to measure the effective tilt or taper of the side wall mold plates.

10 Claims, 8 Drawing Figures

CONTINUOUS CASTING MOLD SIDE WALL ADJUSTMENT SYSTEM

BACKGROUND OF THE INVENTION

The invention relates to an adjustment and measuring apparatus and method for an adjustable width continuous casting mold of the type disclosed and illustrated in prior U.S. Pat. No. 3,964,727 issued June 22, 1976. Such molds are used in the process for forming continuous slabs of molten metal.

The casting mold itself is a box-like container formed of a pair of spaced-apart rigid primary mold members, forming relatively broad opposed casting faces, and side wall mold plates of relatively narrow width spaced-apart and arranged between the primary mold members. The primary mold members and side wall plates form a roughly rectangular cavity, open at both the top and bottom, through which the molten metal flows. The mold members are provided with cooling tubes or passageways for partially cooling the metal in the cavity thus forming a solidified skin surrounding an interior core of molten metal.

In the mold described in the above-mentioned U.S. Pat. No. 3,964,727, the side wall members are supported upon fixed mounting blocks so that they may be adjusted inwardly toward each other or outwardly away from each other by adjusting the longitudinal movement of connectors carried by the blocks. The mounting blocks are also provided with spring pressured bolts, to secure the blocks to the front and rear primary mold members.

Pressure members, such as plungers mounted in the blocks permit spreading apart the primary mold members against the spring resistance for adjusting, inwardly and outwardly, the side wall mold members. As set forth in U.S. Pat. No. 3,964,727, such pressure means are easily and rapidly operable to sufficiently spread apart the primary mold members for rapid adjustment of the side wall mold members when desired.

Among the problems involved in adjusting the width of a continuous casting mold cavity is the time required for a worker to change the mold, for example, from a run of a width of three feet to a subsequent run of a different width such as three and one-half feet. In prior mold adjustments, such as recited in U.S. Pat. No. 3,964,727, it is necessary to shut down the metal flow and manually lower a gauge into the center of the cavity to adjust the side wall inside faces relative to the mold cavity vertical center line. The worker, by the use of feeler gauges, measures the distance from the center to the upper and lower edges and the corners of the side wall mold members while the primary mold members are separated allowing the side members to be moved. This procedure typically takes about twenty-five minutes for the workman to adjust the cavity to cast a different width slab. During each manual gauging, the molten metal is held in its ladle resulting in costly down time for the casting operation.

When the metal partially cools during casting, there is some shrinkage or contraction of the solidified skin and interior core. Thus it is desired to provide a tapered side wall mold plate. The procedure for adjusting the taper or tilt also requires manual gauging and also requires shutting down the metal flow.

Prior to the present invention there was no automatic system for measuring the change in width of a continuous casting mold cavity without the necessity of shutting down the metal flow and manually measuring as previously explained. Furthermore there was no effective, accurate automatic system for measuring or adjusting taper of the side walls. For example, while U.S. Pat. No. 4,171,719 relates to a system for measuring tilt or taper, the physical location of parts and connection between parts necessarily introduces error factors into the system.

SUMMARY OF THE INVENTION

Thus, the invention herein contemplates an improved measuring apparatus and method for continuous casting mold sections wherein distance and taper of the adjustable side wall mold members, relative to the mold cavity center line, may be rapidly determined from outside of the mold cavity. This outside measuring system may be used during all mold adjustments to compute the exact location and/or taper of the inner faces of the mold side wall members relative to the mold cavity vertical center line.

A transducer is mounted in an axial bore extending through a fixed mounting block. The transducer includes a stationary coil and a core movable relative to the coil, and the inner end of the core is anchored to an outer face of a mold side wall. The axial bore is sized to receive the coil of the transducer, and the core is actuated for slidable reciprocation by the mold side wall movement. As the side wall members are advanced the core moves linearly within the coil causing the inductance of the coil to vary according to the position of the core inside the axial bore.

Movement of the core relative to the fixed transducer coil provides an electrical signal, an electronic read-out, etc. The signal enables computation of the exact distance of the mold side wall from the mold cavity center. The mold measuring apparatus determines the side wall position by precisely measuring the movement of the continuous core relative to the transducer coil. The invention thus provides an independent built-in measuring apparatus avoiding the tolerence, loose play, backlash, etc., which are inherent in the various portions of the adjustable length connectors caused, for example, by their pivotal hinge, rotating screw and gear drive portions.

The mold measuring apparatus thus provides a system which is independent of any heat differentials, etc., because the transducer core is always at a known linear displacement relative to the coil. As a result, all gauging inaccuracies are removed from the system. A read-out signal may be fed to a calibrated meter indicating the distance of movement of the mold side wall members with such distance having been correlated relative to the mold cavity center.

The invention further contemplates a measuring apparatus wherein electrical read-outs may be received from a pair of adjustable length connectors associated with each mold side wall. The four connector read-outs may be fed through a calculator or computer to operate drive means which automatically adjusts the locations of each side wall member. Such a simultaneous adjustment system of both upper and lower connectors of each side wall member avoids the down-time problem and delays of having workers measure and move each of the connectors individually.

A feature of the present invention provides a system of determining the location of the side walls of an adjustable width mold wherein the side walls are accurately gauged from their outside faces directly by means of a variable inductance transducer such that all errors inherent in the mold adjustment mechanism are obviated.

As may be appreciated, with upper and lower transducers connected to each side wall mold plate, the relative movement between the upper and lower parts of a single side wall may be gauged or measured to thus calculate the effective tilt or taper of the mold side wall. Alternatively an inclinometer may be used instead of a linear transducer to measure taper of the mold side wall.

The various objects and advantages of this invention will become apparent upon reading the following description, of which the attached drawings form a part.

DETAILED DESCRIPTION

Figure 1:
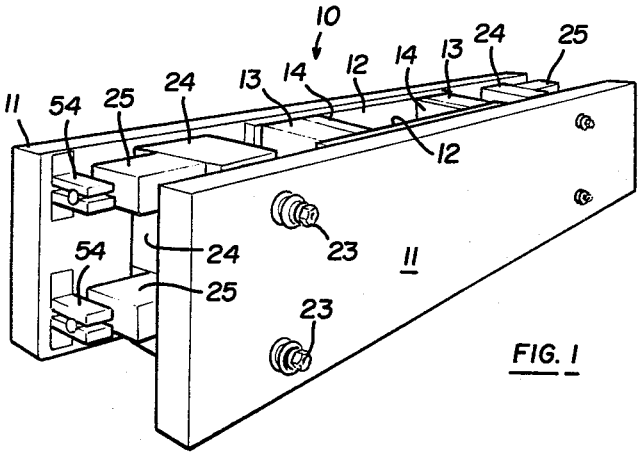
FIG. 1 is a perspective view of a continuous casting mold section incorporating the apparatus for measuring the adjustable mold side members herein.
Figure 2:
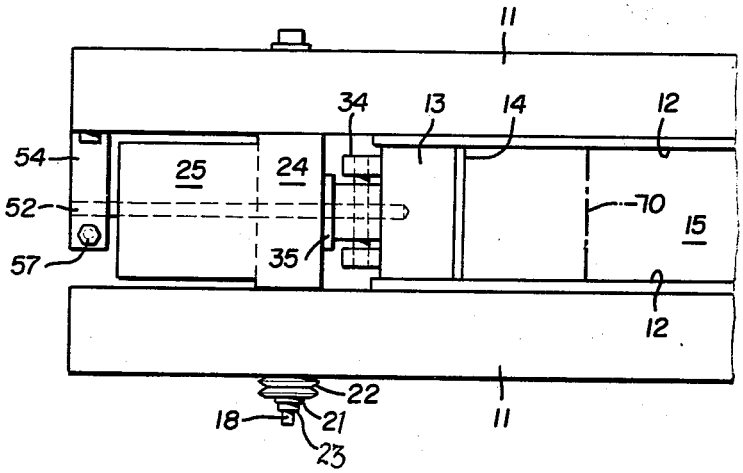
FIG. 2 is an enlarged partial top plan view of the mold section of FIG. 1.

FIGS. 1 and 2 illustrate a mold section 10 of the type used in continuous casting molten steel similar to the mold shown and described in the above-mentioned U.S. Pat. No. 3,964,727. As described in that patent, mold sections are arranged end-to-end to form a continuous, roughly rectangular in cross-section, mold cavity into which molten steel is poured and through which steel passes, is cooled and solidified for continuous withdrawal. The mold sections used in continuous casting are all essentially similar except in many cases, the interiors are curved or tapered to some degree for gradually curving the downward moving steel into a horizontal direction. For purposes of illustration, the various curvatures and mold construction details which are conventional, are omitted.

The mold section 10 basically consists of a pair of spaced-apart primary mold plate-like members 11, each having a mold facing or lining 12, such as a copper, which is suitable, machined to provide required dimensions and curvatures. The mold sections also include a pair of opposite side wall mold members 13, each having a lining or facing 14, similar to that of the primary mold members, with the side wall mold members trapped or held between the primary mold members. Thus, the primary and side wall mold members together form an open ended, i.e., open top and bottom, roughly rectangular in cross-sectional shaped passageway or casting cavity 15. The side wall mold members are arranged a distance inwardly of the vertical edges of the primary mold members.

Figure 5:
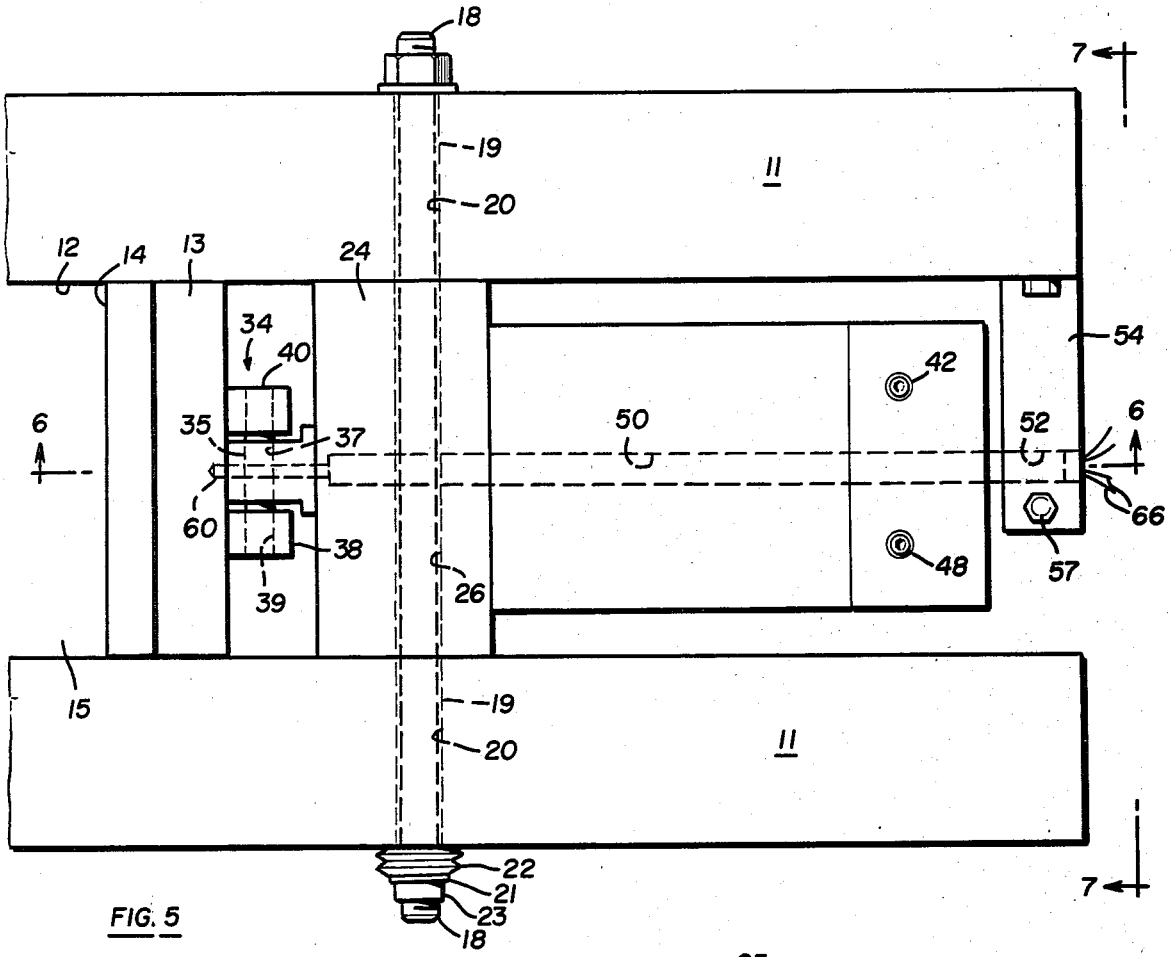
FIG. 5 is an enlarged fragmentary top plan view of one side of the mold section.

Bolts or threaded end shafts 18 encircled by sleeves 19 (FIGS. 5 and 6) extend through aligned openings 20 in the primary mold members. One end of each shaft 18 is provided with washers 21, dish spring washers 22 arranged face-to-face to form a V in cross-section annular spring, threadably retained by nut 23 on the shaft. The shafts themselves loosely connect together the primary mold members. The spring washers 22 apply a spring force which tightly clamps the side wall mold members between the primary mold members and prevents separation thereof under the hydrostatic pressure of the molten metal.

Figure 6:
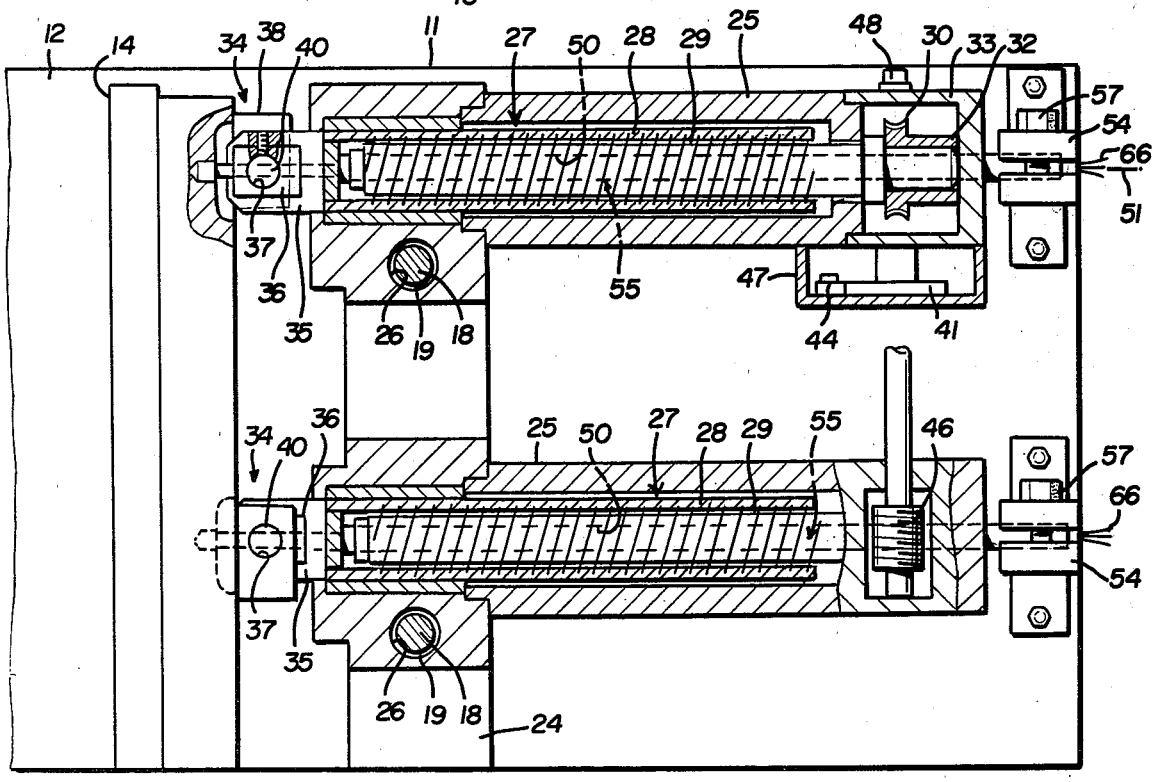
FIG. 6 is an enlarged, partially cross-section, elevational view taken in the direction of arrows 6—6 of FIG. 5.

At each opposite end of the mold, mounting support blocks 24 are provided with each block including upper and lower rectangular housings 25 extending laterally outwardly from the side members. As seen in FIG. 6 the blocks have transverse openings 26 to receive the shafts 18 and sleeves 19 which are journaled through such openings so the blocks may shift upon the sleeves for centering. The sleeves and shafts also resist mold part sagging when the axial pressure of the spring washer members 22 is released.

Each support block 24 is connected to its adjacent side wall mold member by means of a pair of vertically spaced adjustable length connectors 27. As illustrated in FIG. 6, such connectors are formed of internally threaded tubes 28 within which are engaged screws 29. One of said screws is fixably connected to an upper screw driver gear 30 and the other lower screw is fixably connected to a lower screw driver gear 31 shown in FIG. 7. Each of the gears have gear hubs 32 for holding and rotating within gear housing sockets 33 fitted on corresponding ends of the mounting block housings 25.

Each of the tubes extends inwardly of the mold and their inner ends terminate in hinge means in the form of a knuckle joint generally indicated at 34. The hinge joint includes an annular projection or knuckle 35 having its sides flattened at 36 and provided with a transverse bore 37. The flattened ends fit within U-shaped yokes or brackets 38 secured, as by welding, to the mold side members. The brackets 38 are provided with aligned holes 39 to receive transverse pivot pins 40 for pivotally interconnecting the tubes to the brackets and thus to the side member.

Figure 7:
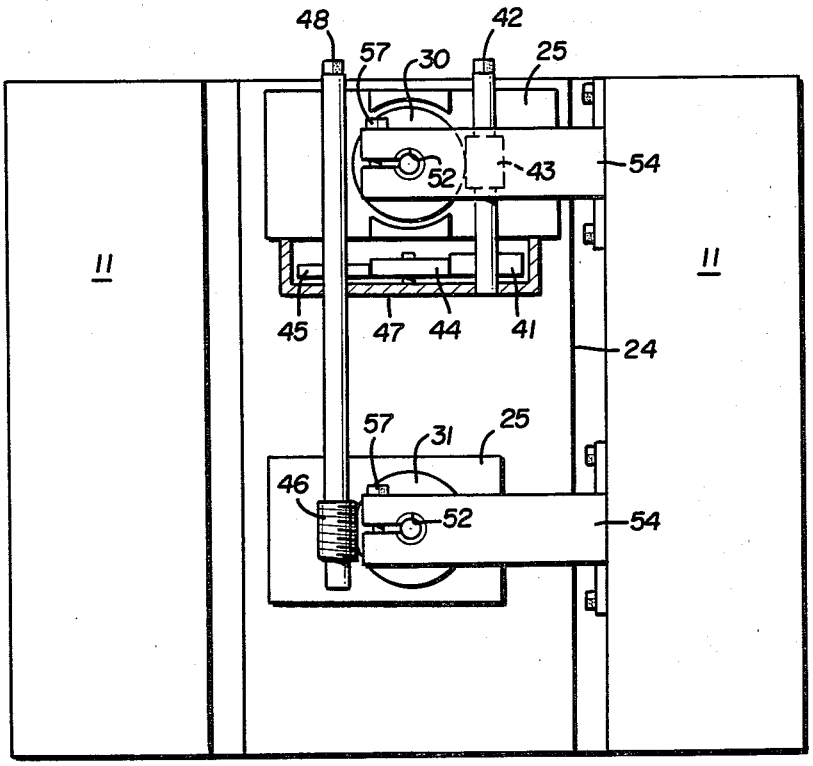
FIG. 7 is an end elevational view taken on line 7—7 of FIG. 5 with parts broken away.

As seen in FIGS. 6 and 7 a drive gear 41 is mounted on the underside of each block upper housing 25 and is provided with a wrench stud 42 (FIG. 7) for engagement by a manually operated wrench. The drive gear is connected to a threaded shaft 43 which extends vertically upwardly through a corresponding opening in the mounting block to engage the upper gear 30. In addition, one or more removable idler gears 44 are mounted on the underside of the block to engage a secondary gear 45 connected to a second threaded shaft 46 extending downwardly from the upper housing 25 for engaging the lower gear 31.

Rotation of the wrench stud 42 causes rotation of the drive gear 41, and of the secondary gear 45, through the idler gear 44, and correspondingly, the shafts 43 and 46. The rotation of these shafts rotate the gears 30 and 31 to rotate the screws 29 within the threaded tubes 28 for thereby moving the tubes either toward or away from the interior of the mold, i.e., for expanding or contracting the lengths of the connectors.

The idler gear 44 may be removed from tooth contact by pulling it upwardly and outwardly from gear box 47 so that the secondary gear 45 may be operated independently by wrench stud 48 for thereby moving one of the connectors more than the other to thereby angularly tip the side members should angularity (i.e., cavity taper or tilt) be desired for casting purposes.

Figure 8:
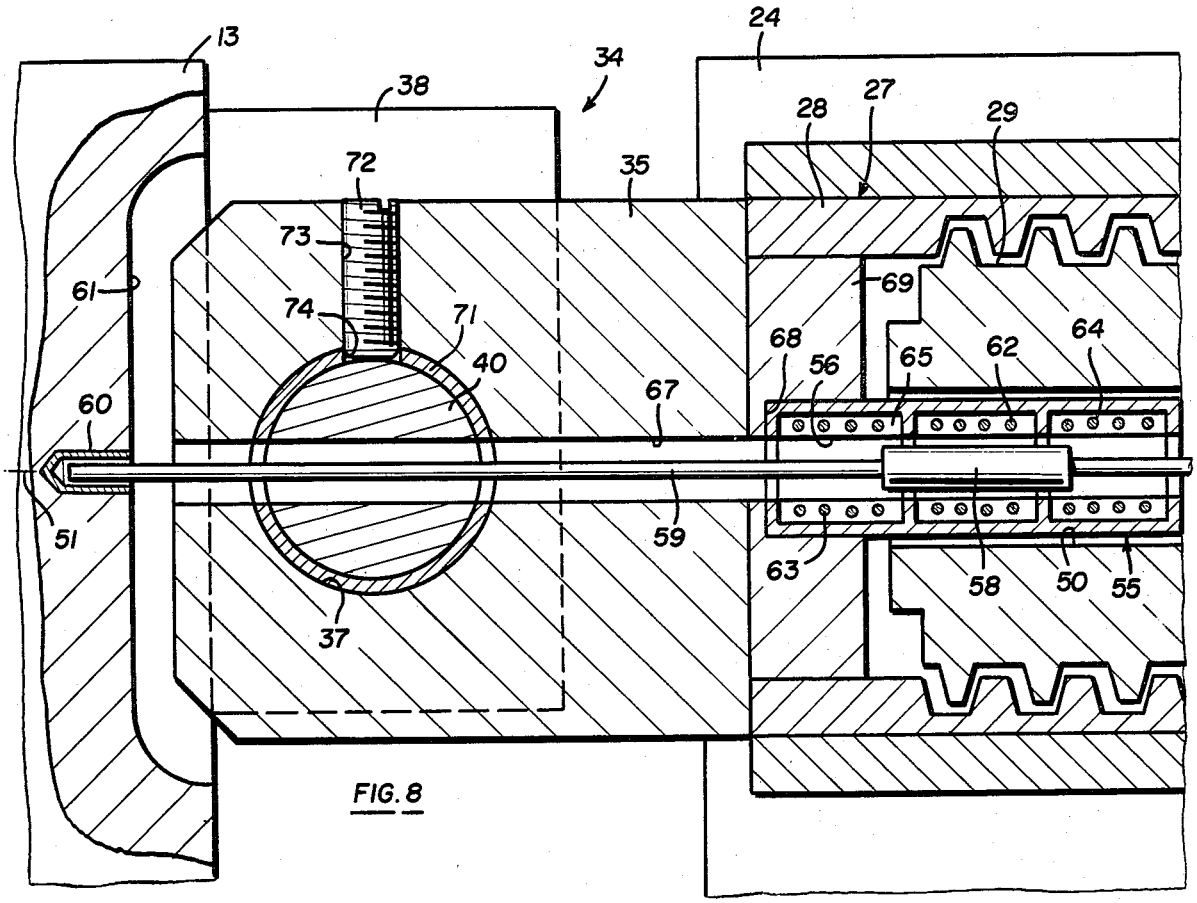
FIG. 8 is an enlarged, fragmentary vertical cross-sectional view of the upper hinge joint of FIG. 6 together with a portion of its connector.

The four connectors each include an axial bore 50 extending through the center of the rotatable screws 29. The bore 50, aligned in the mold longitudinal median plane and including a bore axis 51, further extends through the drive gear hubs and sockets so as to be aligned with axial bore 52 of retaining split clamp 54. The retaining clamp 54 is bolted to the fixed primary right-hand mold member 11 as viewed in FIG. 7. The split clamp bore 52 is sized to receive one end of an inductance transducer 53 having a cylindrical coil housing 55 including an inner bore 56 (FIG. 8). Upon the clamp bolt 57 being tightened, the coil housing 55 is fixed relative to stationary primary right-hand mold member 11. In a preferred form there are four induction coil housings 55, one for each connector 27, with the units being identical in construction.

As seen in FIG. 8, when side wall mold plate movement is to be measured, the four transducers 53 which are LVDTs (linear variable differential transformers) each include coil means positioned in the fixed coil housing 55. Each coil means surrounds a movable magnetic core 58 which in the preferred form is a one-piece elongated rod. The core 58 is movably received in tube axial bore 56 for reciprocal travel therein. The movable core 58 has a reduced diameter rod end portion 59 fixedly anchored at its inner end to the axially movable side mold member 13 as by being threadably received in an anchor sleeve 60 embedded in the transverse face of the mold member preferably inwardly of cooling passage 61. Thus the core is tightly secured to the side wall of the mold.

The mold member 13, upon being moved by connectors 27, provides the actuating force to reciprocally move each core 58 relative to the coil housing bore 56 to vary the inductance of the transducer upon an alternative current being passed through the coil. The inductance is a measure of the core position inside the coil and thus the position of the side wall member. Since the current passing through the coil means is inversely proportional to the inductance, a suitable electrically connected metering instrument (not shown) for measuring the current may be calibrated in terms of the position of the core 58 relative to its fixed coil housing 55.

In the form of the invention shown semi-schematically in FIGS. 2 and 8 each transducer is a mutual inductance type having three coils 62, 63 and 64 of suitable conductive material and wound in the coil housing 55 so as to be encapsulated therein by suitable bonding material such as epoxy 65. The center or primary coil 62 is connected to an AC source which, through magnetic flux in the core 58, induces voltage in the two secondary coils 63 and 64. With the linear displaceable core 58 centrally located, voltages induced in the secondary coils 63 and 64 are equal. When the core 58 is displaced from its known center location by movement of the mold member 13, induced voltage is increased in one coil and decreased in the other. This difference in voltage can be measured at leads 66 as an electrical read-out signal by a calibrated instrument, programmed computer, etc., not shown, to compute the position of the core 58 inside the coil housing 55.

The read out signal may be transmitted to a hand-held meter when adjusting the mold manually with a crank by means of the wrench studs 42 and 48. The invention contemplates, however, that transducer flux signals from each pair of connector coils may be fed to a computer for sensing and recording the flux values at discrete points along the length of magnetic coil housing as the side mold members are moved in unison by motor means to automatically adjust the mold side member.

FIG. 8 shows the fixed coil housing 55 having a cross-sectional diameter sized such that it is received and journally supported in the screw axial bore 50 to enable the screw 29 to rotate about the fixed coil housing 55 during axial travel of the threaded tube 28. The core reduced diameter portion 59 is of a size to provide a relatively small cross-sectional diameter for reception in axial bore portion 67 of the hinge knuckle 35. The bore portion 67 is aligned on the longitudinal bore axis 51.

The reduced diameter bore portion 67 defines a stop shoulder 68 with the axial bore 50 in end member 69 of the tube 28. The coil housing inner end contacts the stop shoulder such that the coil housing 55 is located in the axial bore 50 at a defined distance from the transverse center line 70 of the mold cavity. The pivot pin 40 has a bearing sleeve 71, received in transverse bore 37. The pin and sleeve 71 are held in fixed alignment with axial bore portion 67 by means of set screw 72 threadably retained in vertical knuckle bore 73 and sleeve aperture 74.

Figure 3:
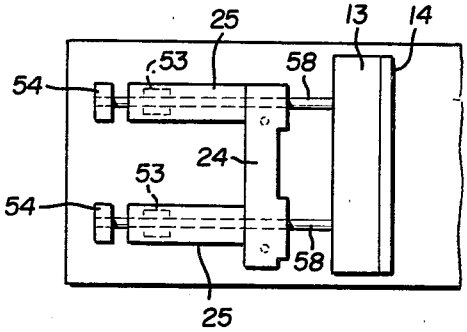
FIG. 3 is a partial front elevation view of the present invention illustrating one form of measuring side wall mold plate movement.

The foregoing is a complete description of a preferred embodiment of the present invention. As can be understood from the foregoing explanation, and from the diagrammatic illustration of FIG. 3, the present invention overcomes the shortcomings of the prior art by directly measuring the mold wall movement since the movable core 58 of the transducer 53 is interior of the mold wall adjustment connectors. Thus the movable core accurately reflects mold wall movement as distinguished from the device of U.S. Pat. No. 4,171,719 which is external to the connectors which move the mold walls and thus has inherent error.

As may be appreciated, the present system not only provides for the adjustment and measurement of the width of the mold cavity but also, if the upper and lower connectors 27 move different amounts, the present system will determine the amount of tilt or taper of the mold wall.

Figure 4:
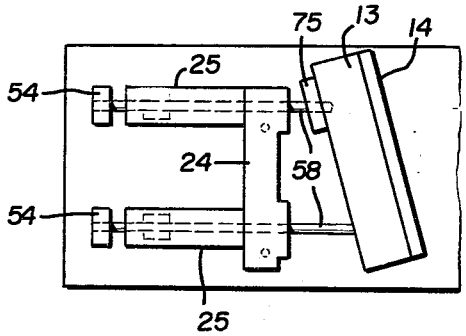
FIG. 4 is a partial front elevation view of the present invention illustrating a second form of measuring side wall mold plate movement.

FIG. 4 illustrates, diagrammatically, a modification of the present system where an inclinometer 75 is placed on the upper core 58. The inclinometer 75 is attached to the mold wall itself rather than to the mold wall movement means and hence the inclinometer will reflect the actual degree of tilt or taper of the mold wall. In the embodiment of FIG. 4, a transducer 53 may be provided on the lower connector to thus provide measurement of both mold cavity width and mold wall taper. Again a part 58 of the inclinometer transducer which forms a horizontal reference for measuring taper, is connected directly to the mold side wall and is positioned interiorly of the connector.

The foregoing is a complete description of the present invention. Various modifications and changes may be made without departing from the spirit and scope of the present invention. The invention, therefore, should be limited only by the following claims.

What is claimed is:

1. Apparatus for measuring the position of at least one side wall mold member relative to the center of an adjustable width continuous casting mold cavity formed of a pair of spaced apart primary mold members, forming opposed casting faces, and side wall mold members arranged between the primary mold members at the opposite sides thereof to provide a roughly rectangular shaped, in cross section, open ended cavity; means for releasably securing the side wall mold members to the primary mold members for permitting movement of at least one side wall mold member toward the other, and including fixed mounting means supported between the primary mold members and outwardly of said one movable side wall mold member, and an adjustable length connector member interconnecting said fixed mounting means and said one movable side wall mold member, comprising:

said connector member containing an axial bore passing completely therethrough;

transducer means having at least a portion thereof secured to said one movable side wall mold member;

at least a part of said transducer means being positioned interiorly of said connector member; and the movement of said one side wall mold member in response to varying the length of said connector member for actuating said transducer means.

2. The invention as defined in claim 1 wherein said transducer means is a linear transducer including fixed coil means and a movable core, said movable core being positioned interiorly of said connector member and secured to said side wall mold member.

3. The invention as defined in claim 1 and further including a pair of adjustable length spaced apart connector members each interconnecting said fixed mounting means and said one side wall mold member; and separate transducer means each associated with one of said connectors, each transducer means having at least a portion thereof secured to said one movable side wall member and each transducer means having at least a part thereof positioned interiorly of one of said connector members.

4. The invention as defined in claim 3 wherein each of said transducer means is a linear transducer including fixed coil means and a movable core, the movable core of each transducer means being positioned interiorly of one of said connector members and secured to said side wall mold member.

5. The invention as defined in claim 1 including:

a pair of adjustable length, elevationally spaced connector members interconnecting said fixed mounting means and said one side wall mold member, the inner end of each said connector member having hinge means pivotally attaching each said connector member to said one side wall mold member;

at least one connector member and its associated hinge means containing an axial bore passing completely therethrough;

a portion of said transducer means extending through the axial bore portion in said hinge means and anchored to said one side wall mold member;

the movement of said one side wall mold member in response to varying the length of at least one of the connector members for actuating said transducer means.

6. The invention as defined in claim 5 wherein:

each of said pair of connector members and their associated hinge means containing an axial bore passing completely therethrough;

a portion of said transducer means extending along a portion of each said axial bore and anchored to said side wall mold member.

7. The invention as defined in claim 5 wherein:

said at least one connector member hinge means including a transversely extending pivot pin such that the axis of said pivot pin, and the axis of said associated axial bore intersect at substantially right angles.

8. The invention as defined in claim 1 wherein:

said adjustable connector member is in the form of an internally threaded axial displaceable tube within which is engaged an axially fixed rotatable screw, with said screw having a portion of said axial bore contained therein.

9. The invention as defined in claim 1 including:

first and second pairs of adjustable length elevationally spaced connector members, arranged such that each said pair interconnects, respectively, on said mounting means and its associated side wall mold member, the inner end of each said connector member having hinge means pivotally attaching each said connector member to its associated side wall mold member;

each said connector member and its hinge means containing an axial bore passing completely therethrough;

transducer inductive coil means extending along at least a portion of each said axial bore;

means for retaining each said coil means in its axial bore at a defined location relative to the mold transverse center line;

an elongated transducer core reciprocally movable in each said axial bore with each core having its one inner end extending through the axial bore portion in its associated hinge means such that each pair of cores have their inner ends anchored to one of said side wall mold members;

the movement of each said side member in response to varying the length of its associated connector members providing the actuating force resulting in the linear movement of its associated pair of cores relative to their respective coil means;

the linear movement of each said pair of cores relative to their respective coil means causing the inductance of each coil means to vary providing electrical signal means from each said coil means proportional to their associated side member movement whereby the distance, and angular orientation of each side member relative to said mold transverse center line can be computed.

10. A method for measuring the movement of at least one adjustable side wall mold member relative to the center of an adjustable width continuous casting mold cavity formed of a pair of spaced apart primary mold members, forming opposed casting cavities, and side wall mold members arranged between the primary mold members at the opposite sides thereof to provide a roughly rectangular shaped open ended cavity, and including a mold adjusting member for moving said side wall mold members relative to the center of said cavity comprising the steps of:

providing a transducer having first and second portions, one of said portions forming a reference for the other portion;

connecting one of said portions of said transducer interiorly of said mold adjusting member to said side wall mold member;

moving said side wall mold member relative to said cavity; and determining the change in position of said first and second transducer portions relative to each other caused by moving said side wall mold member to determine the change in position of said side wall mold member relative to the center of said casting mold cavity.

* * * * *